US008156707B2

(12) United States Patent
Kundel, Sr. et al.

(10) Patent No.: US 8,156,707 B2
(45) Date of Patent: Apr. 17, 2012

(54) STRUCTURAL MEMBERS FOR FORMING VARIOUS COMPOSITE STRUCTURES

(75) Inventors: Robert Kundel, Sr., Cortland, OH (US); Robert Kundel, Jr., Cortland, OH (US); Richard A. Schley, Warren, OH (US); Chris Welker, Cortland, OH (US)

(73) Assignee: Kundel Industries, Inc., Vienna, OH (US)

( * ) Notice: Subject to any disclaimer, the term of this patent is extended or adjusted under 35 U.S.C. 154(b) by 0 days.

(21) Appl. No.: 13/234,337

(22) Filed: Sep. 16, 2011

(65) Prior Publication Data

US 2012/0005980 A1 Jan. 12, 2012

Related U.S. Application Data

(62) Division of application No. 12/319,509, filed on Jan. 8, 2009, now Pat. No. 8,037,658.

(51) Int. Cl.
*E04H 12/10* (2006.01)

(52) U.S. Cl. ..... 52/651.05; 52/655.1; 52/843

(58) Field of Classification Search ..... 52/651.01, 52/651.05, 654.1, 836, 838, 839, 843–845, 52/653.1, 655.1; 212/315; 104/94
See application file for complete search history.

(56) References Cited

U.S. PATENT DOCUMENTS

| | | | | |
|---|---|---|---|---|
| 153,170 | A | 7/1874 | Kellogg | |
| 514,665 | A | 2/1894 | Serrell | |
| 631,655 | A | 8/1899 | Noble | |
| 651,367 | A | 6/1900 | Lanz | |
| 1,472,654 | A | 10/1923 | Jackson | |
| 1,656,810 | A | 7/1924 | Arnstein | |
| 1,629,367 | A | 5/1927 | Thies | |
| 2,790,524 | A | 7/1955 | Herrschaft | |
| 2,737,596 | A | 3/1956 | Haupt et al. | |
| 3,127,962 | A | 4/1964 | James | |
| 3,974,777 | A * | 8/1976 | Monne | 104/94 |
| 4,018,055 | A | 4/1977 | Le Clercq | |
| 4,041,657 | A | 8/1977 | Schuplin | |

(Continued)

FOREIGN PATENT DOCUMENTS

DE 3900047 7/1990

(Continued)

OTHER PUBLICATIONS

Flex-Strut Inc., website catalog excerpts, Dec. 24, 2008, 29 pages, Warren, Ohio, U.S.A.

*Primary Examiner* — Robert Canfield
*Assistant Examiner* — Christine T Cajilig
(74) *Attorney, Agent, or Firm* — Robert J. Herberger

(57) ABSTRACT

Structural members widely adaptable for use to build various composite structures and assemblies having horizontal and vertical supports, such as columns, beams and rails, are shown and described. The composite structural members include a longitudinal channel having a web and first and second legs. Each leg includes a plane that extends from a side of the web and is inclined relative to the web, and a cylinder is located at an edge of the leg that is spaced from the web. Various fittings can be used to engage at least one of the cylinders of the channel to fix the channel in position relative to a second, third and/or fourth channel to form the column, beam or rail. Further, select brackets can be used to attach together columns, beams and rails of the assembly.

9 Claims, 9 Drawing Sheets

U.S. PATENT DOCUMENTS

| | | | | | |
|---|---|---|---|---|---|
| 4,126,978 | A | | 11/1978 | Heller | |
| 4,646,505 | A | * | 3/1987 | Paris | 52/843 |
| 4,660,799 | A | | 4/1987 | Butland | |
| 4,925,330 | A | * | 5/1990 | Cornish | 403/171 |
| 5,314,156 | A | | 5/1994 | Moses | |
| 5,337,908 | A | | 8/1994 | Beck, Jr. | |
| 5,409,255 | A | * | 4/1995 | Alatalo et al. | 280/124.166 |
| 5,669,518 | A | * | 9/1997 | Kundel | 212/315 |
| D430,479 | S | | 9/2000 | McDonald | |
| 6,837,016 | B2 | | 1/2005 | Simmons et al. | |
| 7,966,686 | B2 | | 6/2011 | Turner | |

FOREIGN PATENT DOCUMENTS

| | | |
|---|---|---|
| JP | 2005-97914 | 4/2005 |

* cited by examiner

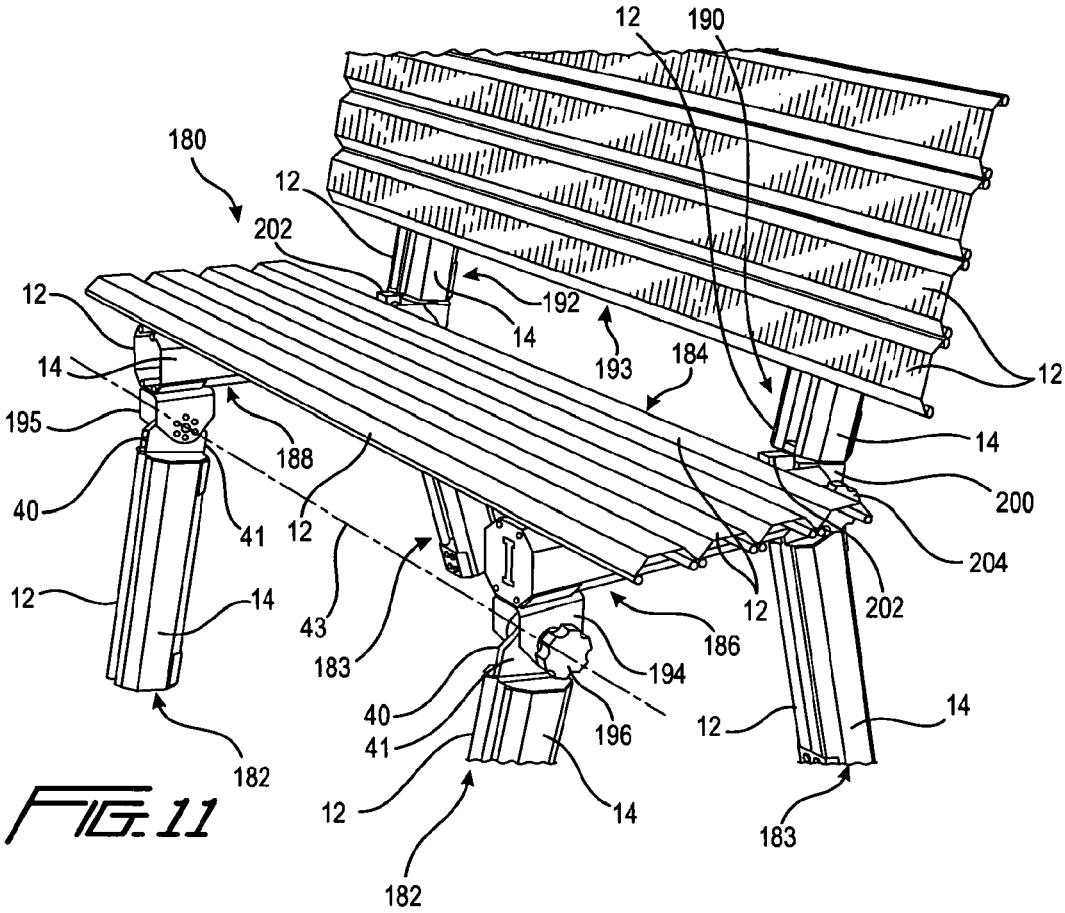
FIG. 11
FIG. 12
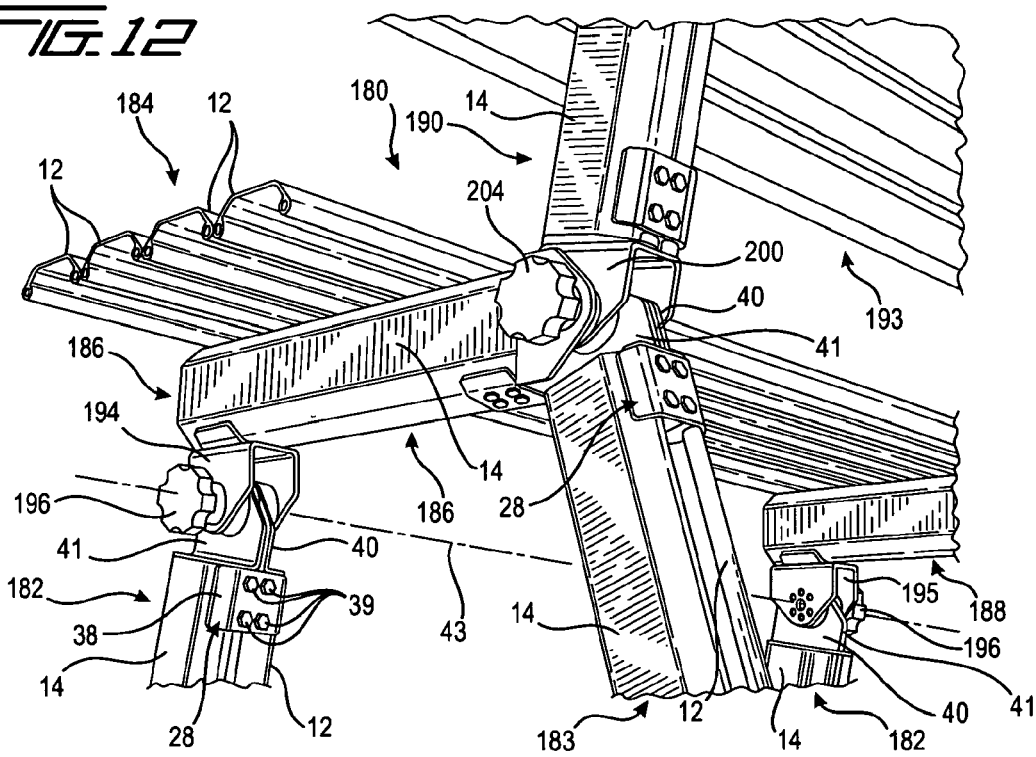

STRUCTURAL MEMBERS FOR FORMING VARIOUS COMPOSITE STRUCTURES

REFERENCE TO RELATED APPLICATIONS

This application is a divisional of U.S. patent application Ser. No. 12/319,509, filed Jan. 8, 2009 now U.S. Pat. No. 8,037,658, the full disclosure of which is incorporated herein by reference.

BACKGROUND OF THE INVENTION

1. Field of the Invention

This invention relates generally to structural members widely adaptable in position and range of use to build various composite structures, including a longitudinal channel member having inclined, spaced legs that extend from a web with a cylinder located at an edge of the leg that is spaced from the web, and/or attachment fittings and brackets for interconnecting composite members in various positions such that different structures can be formed by the members to the desired strength and weight.

2. Description of the Prior Art

Conventional structures are formed with component members having multiple structural shapes suited to the nature and magnitude of the loads carried by the components. Connections among the components are often made by welding, bolting and riveting.

A need exists in industry for component members of a standard shape and whose load-bearing attributes are proven and supported by structural analysis and that can be combined and interconnected to form structural assemblies and subassemblies suited to the nature and magnitude of the loads applied to the structure. Further, a need exists for fittings, brackets and assembly techniques that properly and easily engage the members and produce reliable, sturdy, and durable combinations of the components in multiple configurations that can accommodate various load capacities.

SUMMARY OF THE INVENTION

Composite members that include first and second longitudinal channels, each channel including a web and first and second legs, each leg including a plane that extends from a side of the web and is inclined relative to the web, and a cylinder located at an edge of the leg that is spaced from the web. Fittings are used to engage at least one of the cylinders of each channel to fix the first channel in position relative to the second channel.

The composite members can be interconnected to form various useful structural subassemblies, such as columns, beams and rails used to make larger assemblies, such as framing for a canopy or other enclosure, and/or more load-bearing structures, such as, for example, a support frame for an overhead crane. The composite members can also be used to make smaller products such as tool benches and/or tables.

Fittings, including end plates and brackets, engage the channels and firmly hold them in their desired position relative to other channels of an assembly. Removable mechanical fasteners, such as screws and bolts, engage the fittings and easily connect the components.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

Having generally described the nature of the invention, reference will now be made to the accompanying drawings used to illustrate and describe the preferred embodiments thereof. Further, these and other advantages will become apparent to those skilled in the art from the following detailed description of the embodiments when considered in the light of these drawings in which:

FIGS. 11 and 12 are perspective views of a bench having a frame assembled from the interconnected channels of FIGS. 1 and 2.

DESCRIPTION OF THE PREFERRED EMBODIMENT

Figure 1:
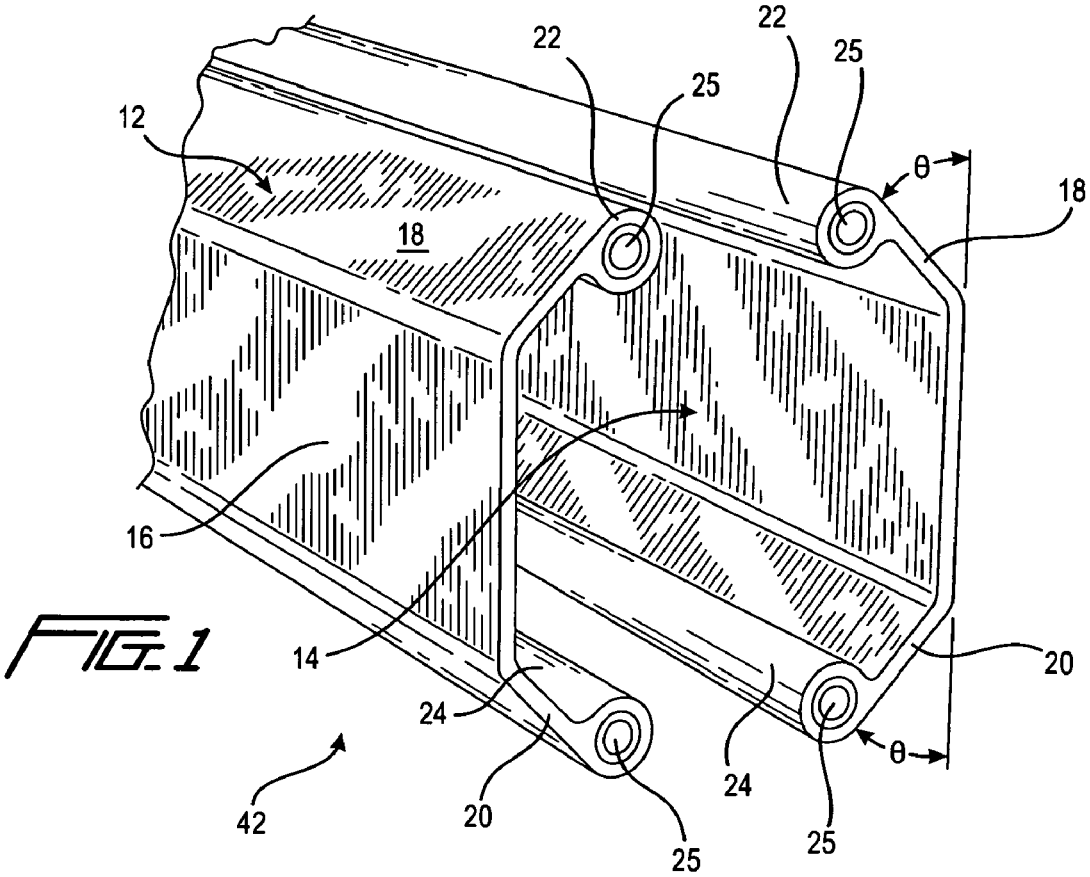
FIG. 1 is a perspective view of a two channels assembled so that their respective webs are mutually parallel.
Figure 2:
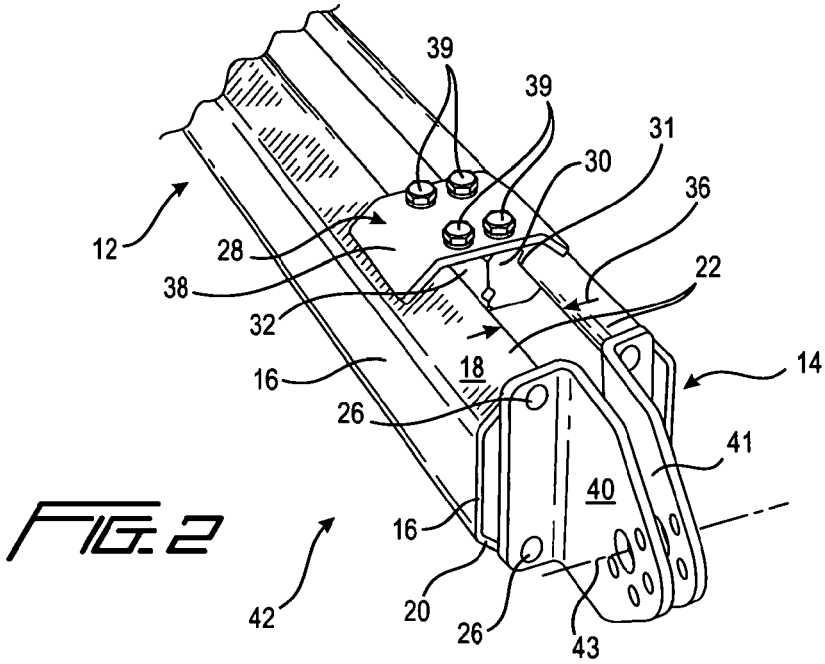
FIG. 2 is a perspective view of the channels of FIG. 1 interconnected by a fitting and bracket.
Figure 7:
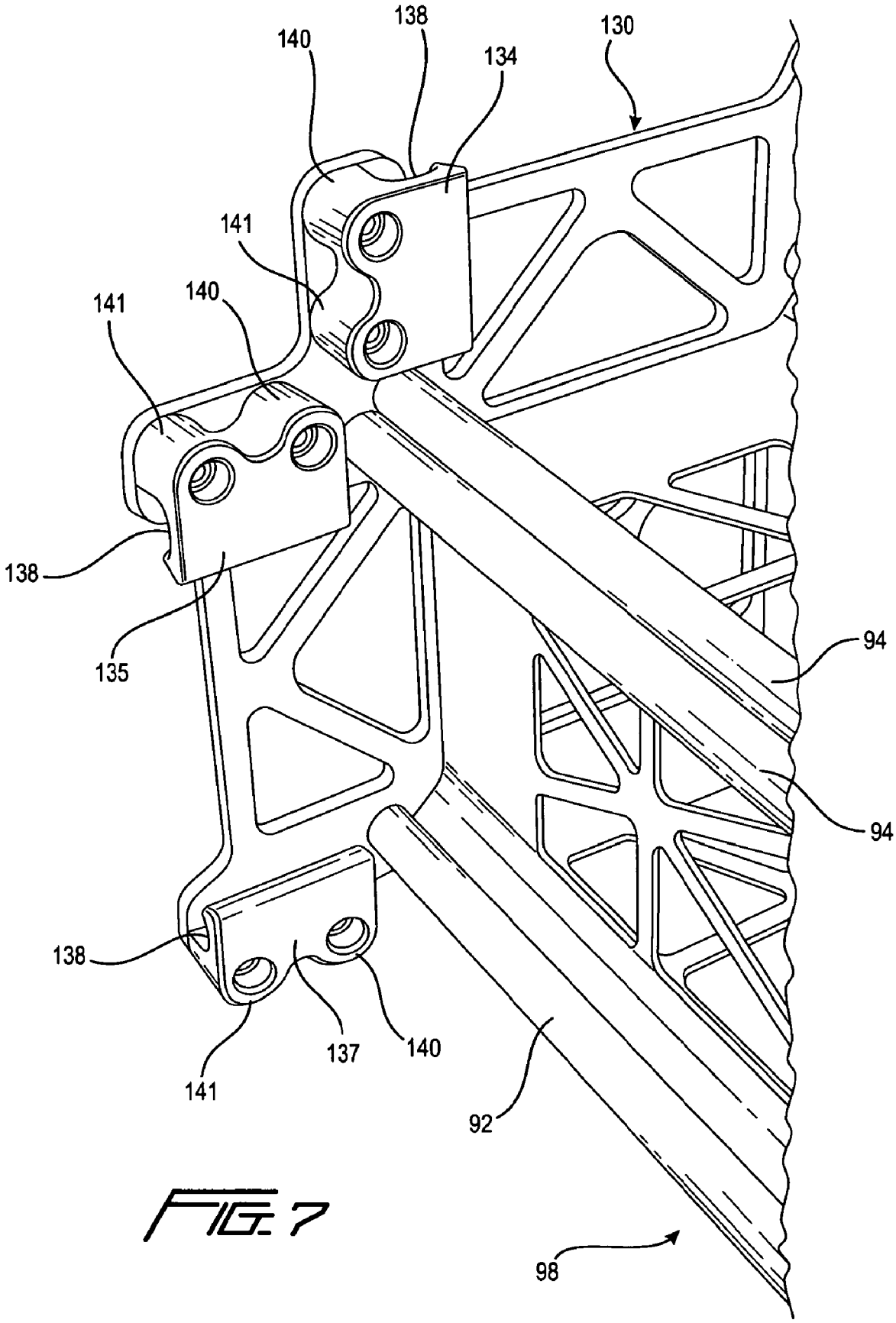
FIG. 7 perspective view showing the top of a column with an end or top plate fitting.

Referring now to the drawings, there is illustrated in FIGS. 1 and 2 first and second longitudinal structural channels 12, 14. Each channel 12, 14 includes a web 16, a first leg 18 and a second leg 20. Leg 18 includes a plane that extends from a side of the web 16 and is inclined at angle θ relative to the web, and a cylinder 22 that is located along a side edge of leg 18 that is spaced from the web. In similar design, the leg 20 includes a plane that extends at the opposite side of the web 16 from the location of leg 18 and is inclined at the same angle θ relative to the web. In like fashion, leg 20 has a cylinder 24 located along a side edge of the leg 20 that is spaced from the web. Notable, the cylinders 22, 24 increase structural strength of the channel and may be solid or tubular. A threaded hole 25 may also be tapped in each end of the cylinders 22, 24 to receive a connector 26, which secures each channel 12, 14 to another element of a composite member, such as brackets 40, 41 as shown in FIG. 2 or an end plate 130 as shown in FIG. 7.

Figure 4:
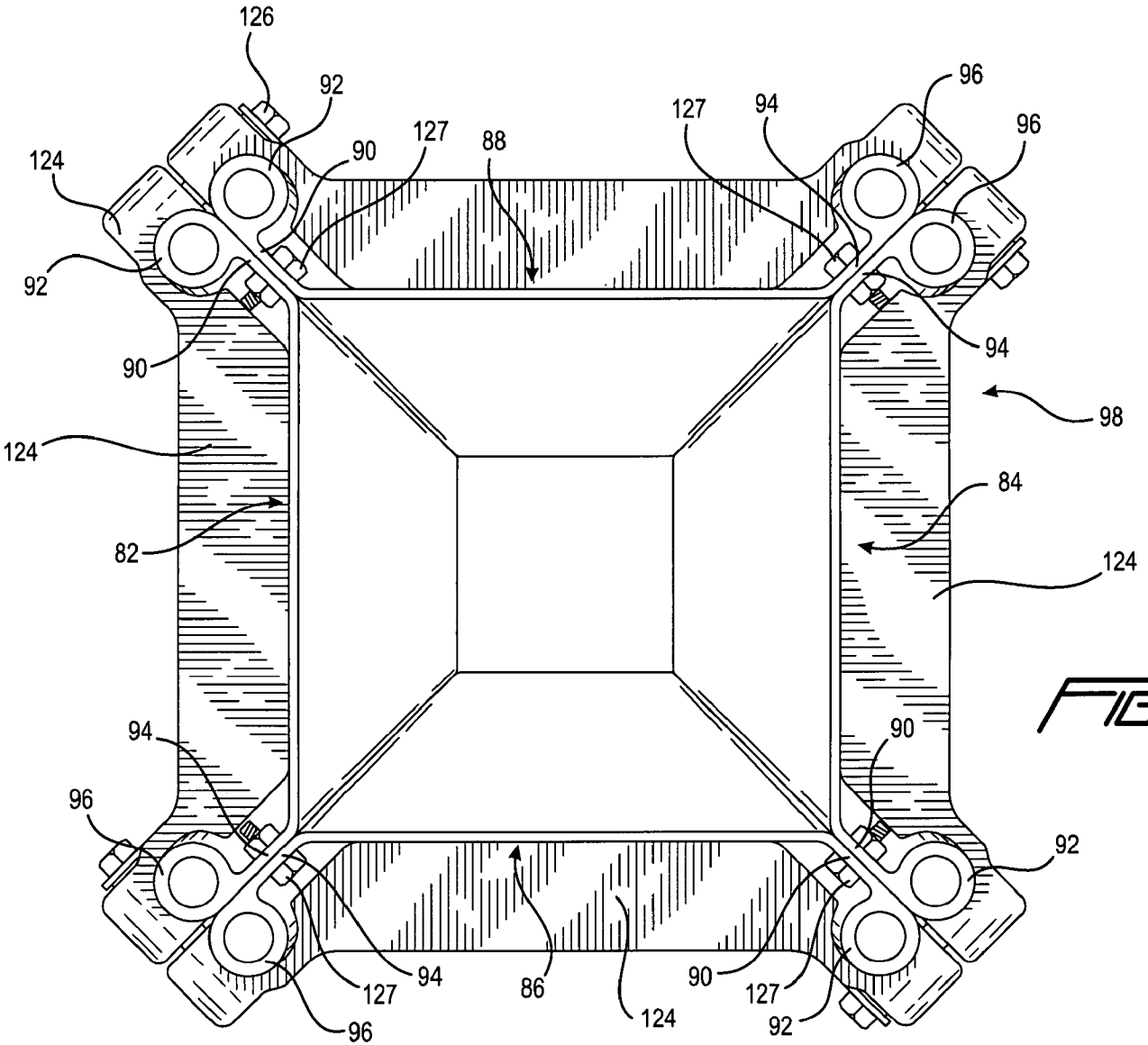
FIG. 4 is a top cross-sectional view showing a four-sided column formed by four of the channels.

The inclined angle θ of the channels 12, 14 is preferably 45 degrees, particularly for the assembly of four-sided columns as shown in FIG. 4 and described in detail below. However, angle θ may be anything less then 90 degrees to form different multi-sided columns. For example, angle θ could be 30 degrees to best form and assemble three-sided columns.

Figure 10:
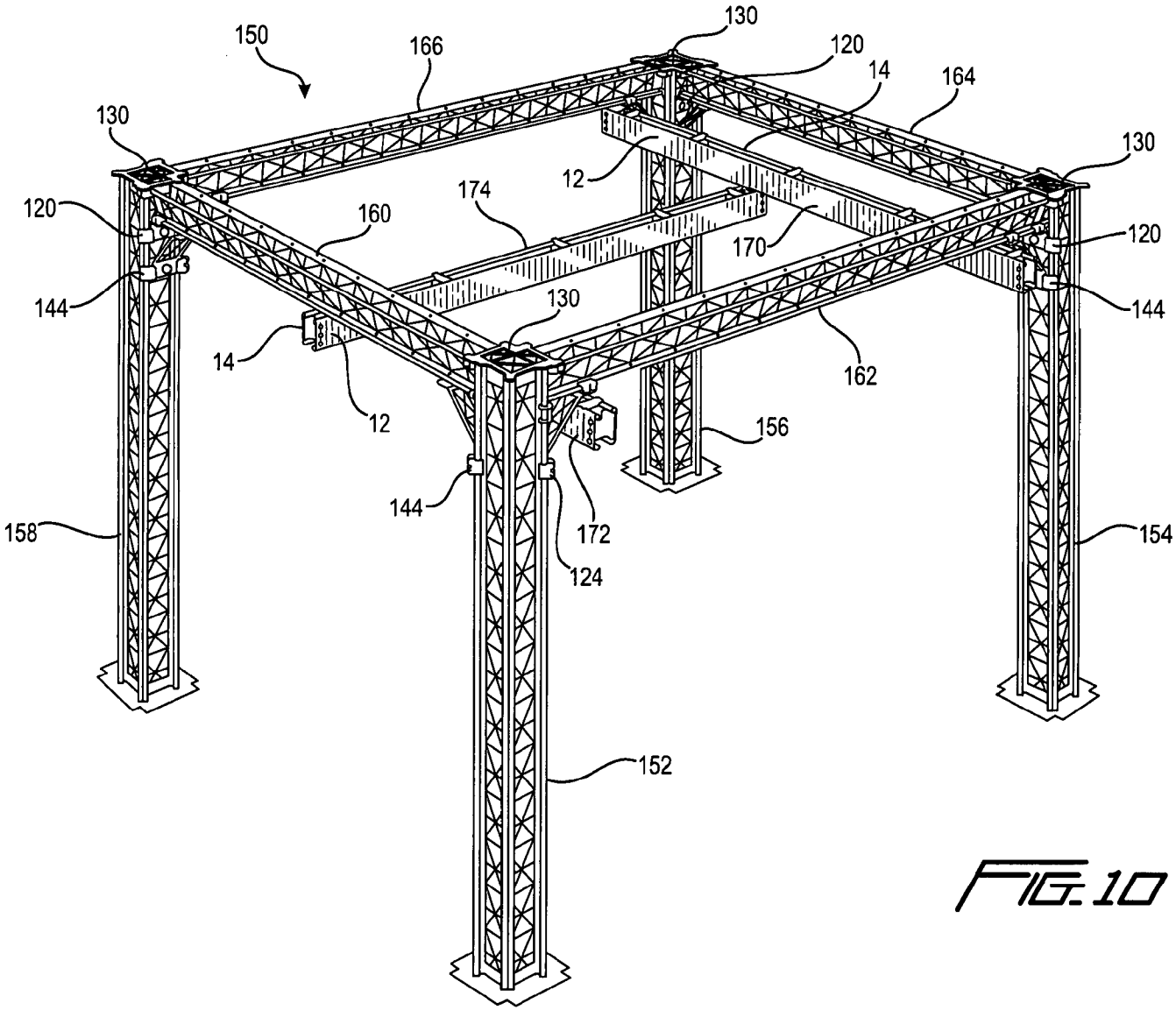
FIG. 10 is a perspective view of a supporting frame for an overhead crane having columns, rails and beams formed of interconnected channels.

Channels 12, 14 may be mutually spaced by various fittings, such as a parallel separation fitting 28, which engages the cylinder 22, 24 of each channel for fixing the first channel in position relative to the second channel, when the channels are assembled to form, for example, beams 42 and/or 170, 174, as shown in FIGS. 2 and 10, respectively, and/or a bench leg 182, 183 as shown in FIG. 12. More specifically, with reference again to FIG. 2, the separation fitting 28 includes a first inner block component 30, having a concave contour 31 to contact and engage a length of cylinder 22 of channel 14, and a second inner block component 32, having a like concave contour 31 to contact and engage a length of cylinder 22 of channel 12, as well as the adjacent inner block component 30, producing a space 36 between the channels 12, 14. The separation fitting 28 includes a cap 38, which overlaps the inner block components 30, 32, a length of cylinders 12, 14 and a portion of the corresponding legs 18. Attachments 39 secure the inner block components 30, 32 to the cap 38, and by compression therebetween, hold the respective cylinders 22 and, in turn, the corresponding webs 16 of each channel 12, 14 substantially parallel.

When assembled, the channels 12, 14 and fitting 28 form a leg and/or beam 42. If needed, angle bracket 40 can be secured at an end of the beam 42 by connectors 26 screwed in the end to channel 12 and a second angle bracket 41 attached in like fashion to channel 14. This subassembly can then be attached to another lateral beam or a column to form an angular relationship therebetween, and the angular relationship can be selected, adjusted and fixed about a pivot axis 43, as described below with reference to FIG. 11.

Figure 3:
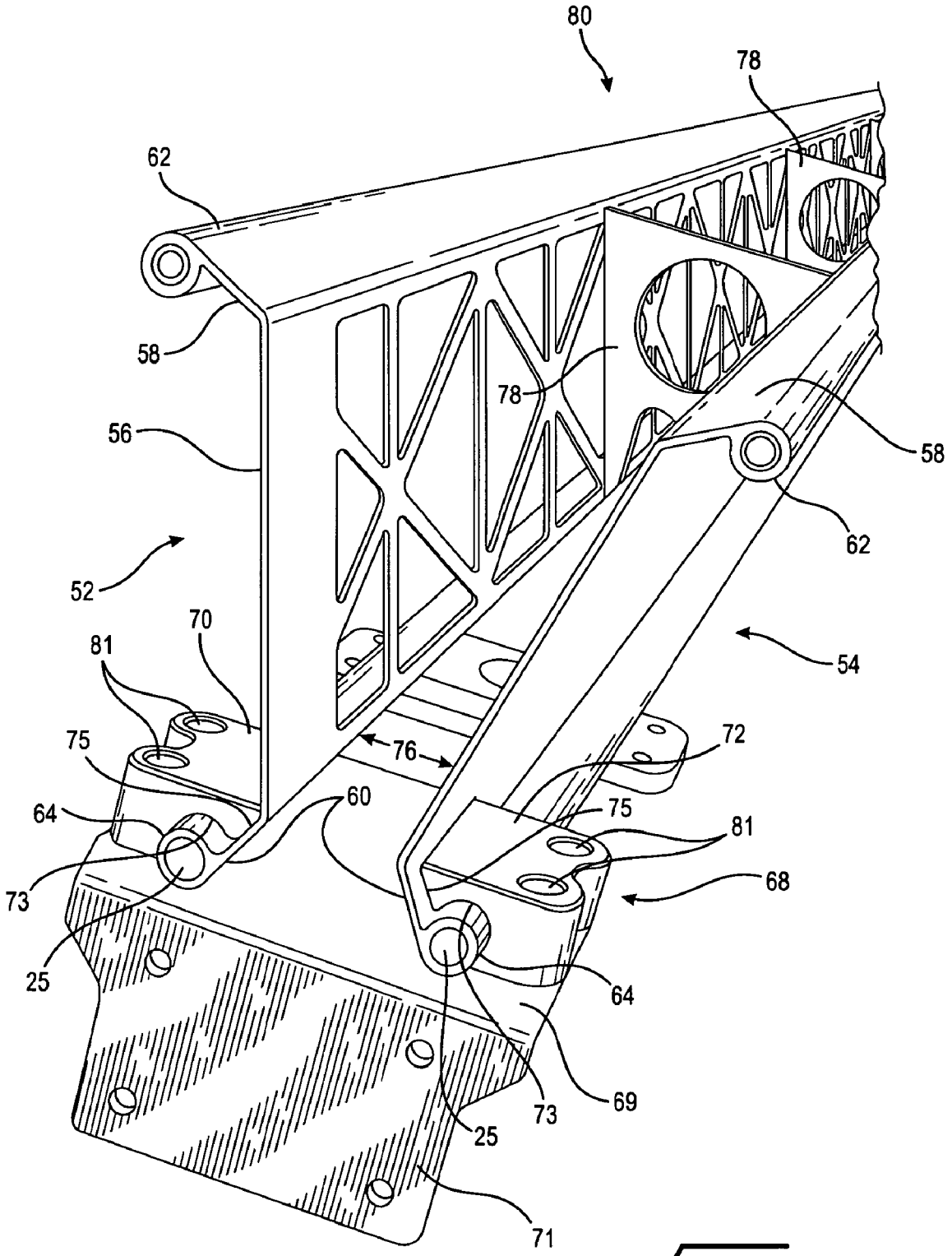
FIG. 3 is a perspective view of two channels forming a beam, whose webs are mutually inclined.

As an alternative to the solid webs 16 shown in channels 12, 14, the first and second longitudinal structural channels 52, 54 shown in FIG. 3, each includes a perforated web 56. From the perforated web 56 extend a first leg 58 and a second leg 60. As with the solid channels 12, 14, the leg 58 in channels 52, 54, respectively, is in a plane that extends from a side of the corresponding web 56 and is inclined, preferably at 45 degrees, relative to the web. A cylinder 62 is located on each of the legs 58 along a side edge that is spaced from the web 56. Also, the leg 60 in channels 52, 54, respectively, is in a plane that extends at the opposite side of the web 56 from the location of leg 58 and is inclined preferably at 45 degrees relative to the web. A cylinder 64 is located on each of the legs 60 along a side edge that is spaced from the web 56. The cylinders 62, 64 may also be solid or tubular, as are cylinders 22 and 24. A threaded hole 25 may be tapped in each end of the cylinders 62, 64 to receive a connector 26, which secures each channel 52, 54 to another element of a composite member, as described above with reference to channels 12 and 14.

Continuing to referring to FIG. 3, channels 52, 54 may be mutually spaced by an angular bracket 68. Bracket 68 includes outer block components 70, 72, each of which has a concave contour 73 to engage a length of cylinders 62, 64 and a planar face 75 to engage legs 58, 60 of the channel 52, 54, respectively, and to hold the web 56 of channel 52 in angular position relative to the web of the channel 54, producing a space 76 between the cylinders 62, 64. Attachments secure the outer block components 70, 72 to a face plate 69 by compression therebetween, engage the respective cylinders 62, 64 to hold the corresponding webs 56 of each channel 52, 54 in angularly disposition. Bulkheads 78, spaced along and secured to the channels 52, 54, produce a composite rail 80, whose webs 56 are inclined mutually. Outer block components 70, 72 of angular bracket 68 provides holes 81 to attach to flange 71, which extends perpendicular from the face plate 69, by which rail 80 can be connected to other members, such as a column 98, as shown in FIG. 6 and described below.

Channels 82, 84, 86, 88 shown in FIG. 4, which are substantially similar to those of FIGS. 1 and 2, but with wider web sections, may be interconnected to form a longitudinal column 98. The webs of the first and third channels 82, 84 are mutually spaced and parallel. The webs of the second and fourth channels 86, 88 are mutually spaced and parallel, and are perpendicular to the webs of the first and third channels 82, 84. Notably, legs 90 of channels 82, 88, as well as channels 84, 86, are mutually adjacent and substantially parallel as result of the 45 degree incline of each leg from its corresponding web. As a result, of course, corresponding cylinders 92, located along the side edge of its respective legs 90 are also adjacent and parallel. In like fashion, legs 94 of channels 82, 86, as well as channels 84 and 88, are also mutually adjacent and substantially parallel as result of the fixed 45 degree incline of each leg from its corresponding web, and corresponding cylinders 96 are aligned adjacent and parallel.

As described with reference to cylinders 22, 24, the cylinders 92, 96 may be solid or tubular, and threaded hole 25 may be tapped in each end of the cylinders to receive a connector, to secure the respective channel to another fitting or bracket member of the composite structure.

Figure 5:
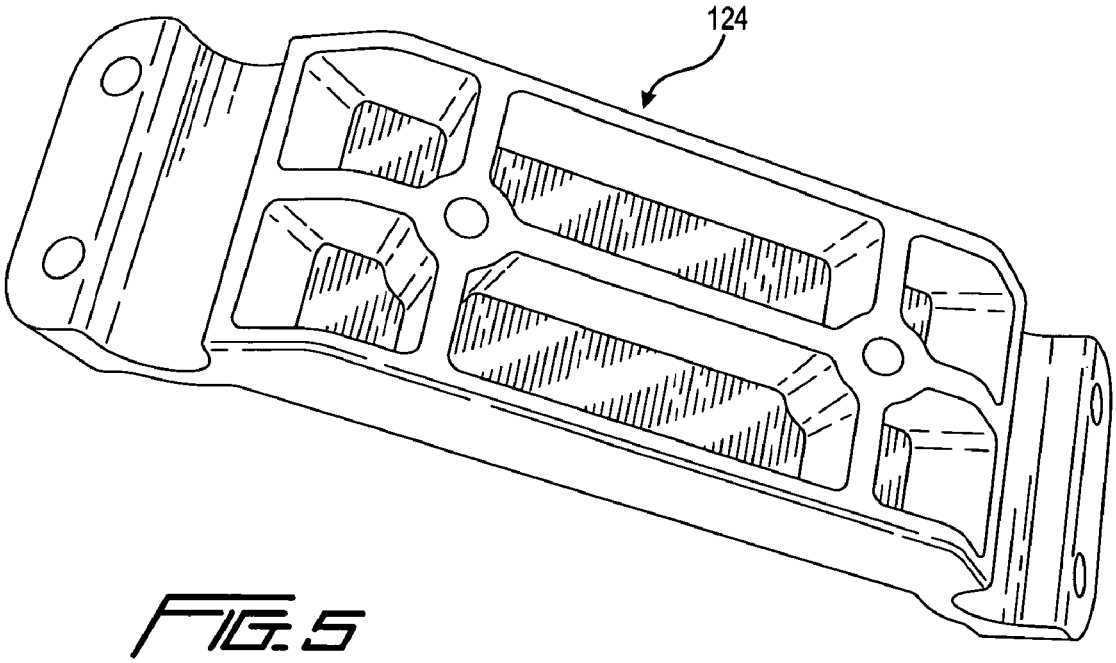
FIG. 5 is a perspective view of a column fitting used to interconnect the channels shown in FIG. 4 to form the column having four channels.
Figure 6:
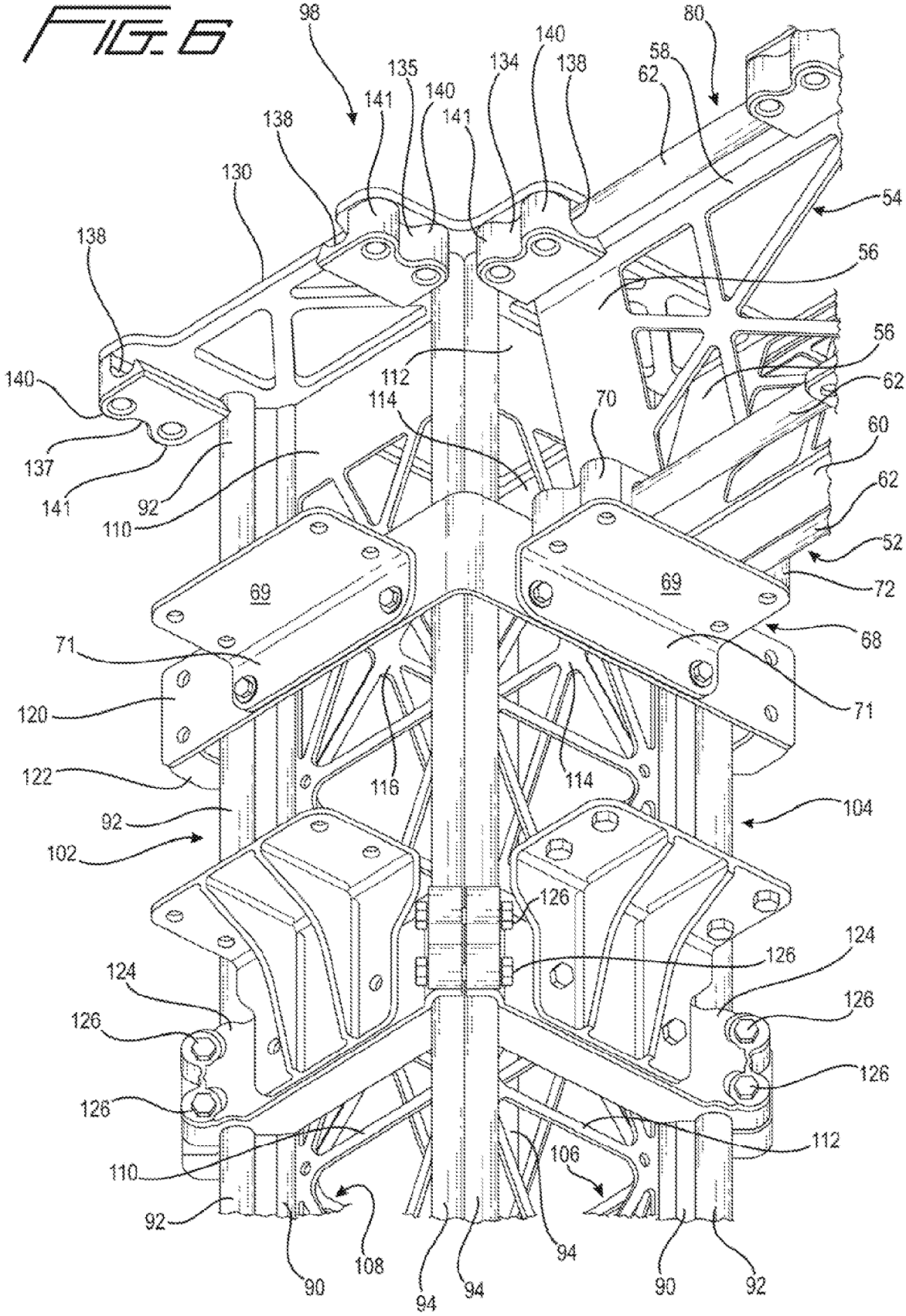
FIG. 6 is a perspective view showing fittings and brackets forming a column having four channels whose webs are perforated to reduce weight without substantially effecting channel strength.

FIG. 4 illustrate interconnected column fittings 124, which engage a length of cylinders 92, 96 of their corresponding channels and holds the legs 90, 94 of those channels in position, as best seen in FIGS. 5 and 6, producing the hollow column 98. Fasteners 126, 127 interconnect the fittings 124.

FIG. 6 illustrates a column 98 comprising four interconnected channels 102, 104, 106, 108 arranged similarly to channels 82, 84, 86, 88 of FIG. 4. The webs 110, 112, 114, 116 of channels 102, 104, 106, 108 are perforated similarly to webs 56 shown in FIG. 3. The webs 110, 114 of channels 102, 106 are mutually spaced and parallel. The webs 112, 116 of channels 104, 108 are mutually spaced and parallel, and perpendicular to the webs of channels 102, 106. The legs 90, 92 and cylinders 92, 96 are arranged as shown in FIG. 4.

FIG. 6 illustrates several fittings and brackets, including a perimeter fitting 120, which engages a length of cylinders 92, 96 of channels 102, 104, and holds together the legs 90 and 94. An attachment fitting 122, secured to the perimeter fitting 120, engages a length of cylinders 92, 96 of channels 106, 108, and holds the legs 90, 94 of channels 106, 108 in position to secure the hollow column 98, as well as provide engagement to the perpendicular rail 80.

Figure 8:
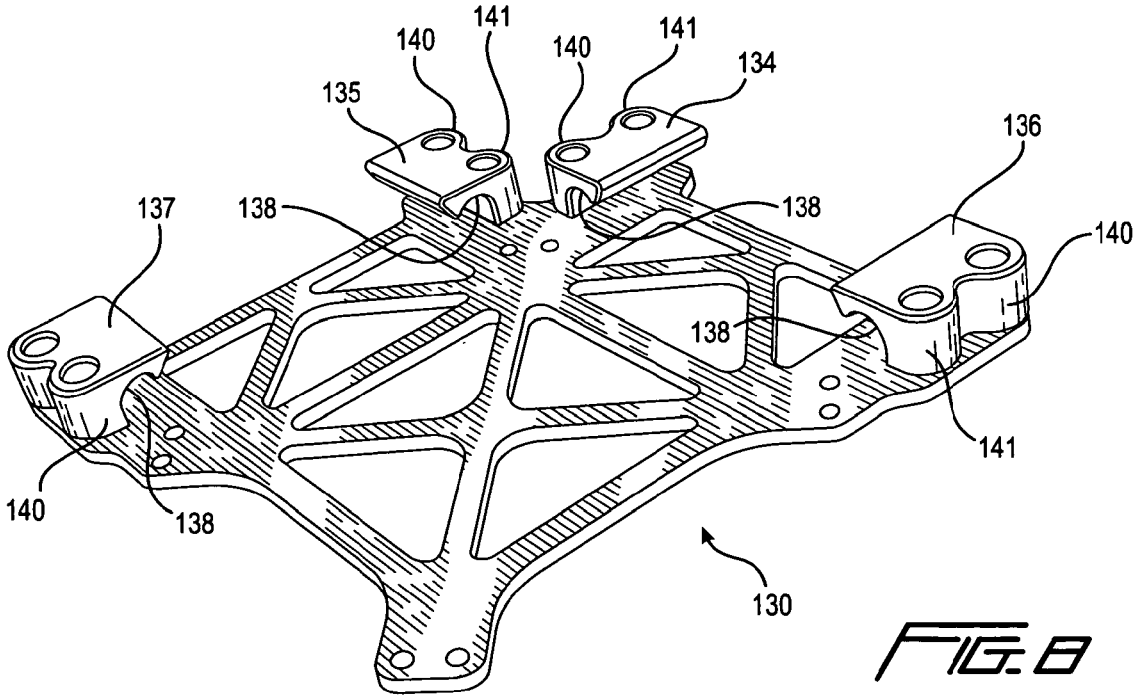
FIG. 8 is a perspective view showing the lower surface of the end plate fitting of FIG. 7 with individual cylinder clamping blocks at the corners.
Figure 9:
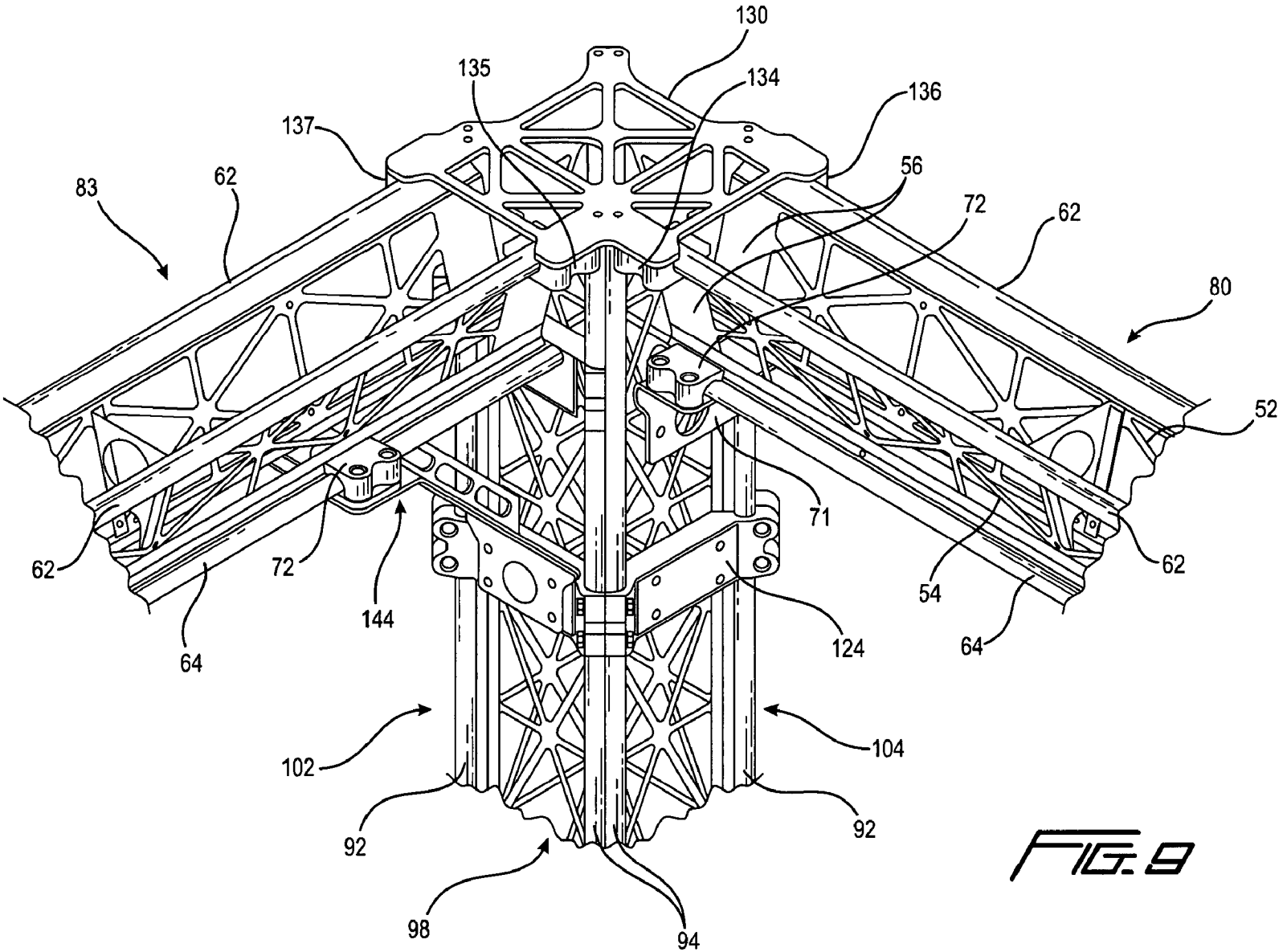
FIG. 9 is a perspective view looking downward on the column of FIG. 7 and showing interconnected beams shown in FIG. 3.

FIGS. 6, 7 and 9 illustrate a perforated column 98 and end plate 130 (best seen in FIG. 8) which is attached at the top of column 98. Plate 130 can be used to secure two perpendicular rails 80 extending outward from column 98, although only one of those rails is shown in FIG. 6. However, in FIG. 9 two perpendicular rails 80, 83 are shown attached to column 98. The upper ends of the cylinders 92, 94 of channels 102, 104, 106, 108 contact the underside of plate 130 and are secured thereto by bolts engaging corresponding threaded holes 25 tapped in each end of the cylinders as described above. Blocks 134, 135, 136, 137 are also secured by fasteners to the underside of plate 130. Like inner block components 30, 32, each block 134, 135, 136, 137 is formed with a concave cylindrical mating surface 138. Notably, its axis is directed horizontally when the plate 130 is installed on column 98.

FIG. 6 shows that rail 80 is secured to plate 130 by inserting the upper cylinder 62 of channel 54 into block 134, thereby engaging its surface 138 and the lower surface of plate 130. Fasteners located at the lugs 140, 141 on block 134 secure block 134 and rail 80 to plate 130. Rail 80 is further secured to plate 130 by inserting the upper cylinder 62 of the opposing channel 52 (shown in FIG. 3) into block 136 (shown in FIG. 8), thereby engaging its surface 138 and further clamping the cylinder 62 to the lower surface of the plate 130. Fasteners located at the lugs 140, 141 on block 136 secure block 136, and therefore rail 80, to plate 130. The rail 80 is further supported on column 98 by the angle bracket 68, which is secured to perimeter fitting 120 and supports bracket 68, into which the lower cylinders 64 of channels 52, 54 are inserted and clamped. Fasteners in holes 81 (best seen in FIG. 3) in outer block components 70, 72, align with holes in the faceplate 69 of bracket 68 to secure the lower cylinders 64 of channels 52, 54 to the bracket 68. FIG. 6 also shows column fittings 124 securing the channels 102, 104, 106, 108 of column 98 together.

As shown in FIG. 9, a second rail 83 is secured to column 98 by inserting each of its upper cylinders 62 into the concave, cylindrical mating surfaces 138 of blocks 135, 137, and is supported by the diagonal bracket 144. Fasteners inserted into holes 81 in outer block components 70, 72, as described above, secure the second rail 83 to the diagonal bracket 144.

FIG. 10 is a perspective view of a support frame 150 for an overhead crane, which is a composite structure comprising columns, each column 152, 154, 156, 158 being similar to column 98; rails, each rail 160, 162, 164, 166 being similar to rail 80; beams, each beam 170, 172 being similar to beam 42; and a gantry 174 similar to beam 42. Each of the columns, rails, beams and the gantry is an assembly of interconnected channels as previously described.

Each corner column 152, 154, 156, 158 comprises four vertically aligned, interconnected channels 102, 104, 106, 108, whose webs 110, 112, 114, 116 form a hollow rectangular cross-sectional shape. The upper portion of the frame 150 comprises four rails 160, 162, 164, 166, each rail supported on two of the columns and comprising two horizontal interconnected channels 52, 54 whose webs 56 are inclined mutually. Two beams 170, 172, supported on two of the rails 162, 166, each comprise two interconnected channels 12, 14, whose webs 16, are mutually parallel and spaced mutually forming a track that extends along a length of the respective beam. The gantry 174 is supported on a track for travel along the length of the beams 170, 172, the track being provided by the outer surface of the cylinders 24 and the space between the channels 12, 14 of each beam 170, 172. The gantry 174 comprises two interconnected channels 12, 14 for supporting the trolley of the crane.

FIGS. 11 and 12 illustrates a bench 180, whose frame comprises front legs 182, rear legs 183, which are similar to beam 42 described above; seat support rails 186, 188; and, back rails 190, 192 (i.e. each assembled from the interconnected channels 12, 14 described with reference to FIGS. 1 and 2). The seat 184 comprises channels 12 supported on rails 186, 188; the backrest 193 comprises channels 12 supported on rails 190, 192. The angle brackets 40, 41, secured to the upper end of the front legs 182, are connected, respectively, to angle brackets 194, 195, secured to the seat rails 186, 188. An adjustment knob 196, engaged with aligned holes on the brackets 40, 41, 194, 195, can be rotated about axis 43 to permit angular adjustment of the front legs 182 relative to the seat rails 186, 188.

Similarly, the angle brackets 40, 41, secured to the upper end of the rear legs 183, are connected, respectively, to angle brackets 200, 202, secured to the back rails 190, 192. An adjustment knob 204, engaged with aligned holes on the brackets 40, 41, 200, 202, can be rotated about the axis of knob 204 to permit angular adjustment of the rear legs 183 and back rails 190, 192 relative to the seat rails 186, 188.

It should be noted that the present invention can be practiced otherwise than as specifically illustrated and described, without departing from its spirit or scope. It is intended that all such modifications and alterations be included insofar as they are consistent with the objectives and spirit of the invention.

What is claimed is:

1. A composite frame assembly, comprising:

column and rail channels, each channel including a web and first and second legs, each leg extends from a side of the web and is inclined relative to the web to form a concave interior, a cylinder is located at an edge of each leg that is spaced a radial length from the web, and a plane outer surface of each leg is tangential to the respective cylinder of the corresponding leg so that an outer surface of the cylinder extends from the plane surface of the corresponding leg and continues around on an opposite side of the plane surface and within the concave interior of the respective channel, so that the plane surface of each leg and outer surface of the respective cylinder tangentially extended therefrom forms a flat exterior face;

columns, each column comprising interconnecting column channels having paired legs and webs forming a hollow rectangular cross-sectional shape;

a rail comprising first and second rail channels supported on two of the columns; and a plurality of fittings with each fitting engaging at least one of the cylinders of the first and second rail channels for fixing the first rail channel in position relative to the second rail channel by clamping the respective cylinder and a portion of the corresponding plane surface of the adjoining leg to define an angle at which the web of the first rail channel is inclined relative to the web of the second rail channel.

2. The composite frame assembly of claim 1, wherein at least one fitting further comprises:

a cap overlapping corresponding legs of each rail channel and secured to an inter component of the fitting, the inter component having a concave mating surface to engage at least a portion of the outer surface of the corresponding cylinder, wherein the fitting engages the cylinder of the corresponding leg of each rail channel and defines a space between the first rail channel and the second rail channel.

3. The composite frame assembly of claim 2, wherein the space between the channels provides access to a track formed by the cylinders opposite the cylinders of each channel that are engaged by the fitting, the track extending along a length of the channels.

4. The composite frame assembly of claim 1, wherein:

the plane surface of each leg of each channel is inclined at an angle substantially 45 degrees relative the web of the channel;

the plane surface of one of the paired legs of a first column channel is parallel to the plane surface of the corresponding paired leg of a second column channel; and the paired parallel plane surfaces are secured mutually.

5. A composite frame structure for supporting a crane, comprising:

column, rail, beam and gantry channels, each channel including a web and first and second legs, each leg extends from opposite sides of the web and is inclined relative to the web to form a concave interior, a cylinder is located at a longitudinal side edge of the leg spaced from the web, and a plane outer surface of each leg being tangential to the respective cylinder of the corresponding leg so that the cylinder is on the opposite side of the plane surface and within the concave interior of the respective channel;

columns, each column comprising interconnected column channels whose webs form a hollow rectangular cross-sectional shape;

rails, each rail supported on two of the columns and comprising first and second horizontal interconnected rail channels whose webs are inclined mutually, a plurality of fittings, each fitting engaging at least one of the cylinders of the first and second horizontal interconnected rail channels for fixing the channels in position by clamping the respective cylinder and a portion of the corresponding plane surface of the adjoining leg to define an angle at which the web of the first rail channel is inclined relative to the web of the second rail channel;

beams, each beam supported on two of the rails, each beam comprising two interconnected beam channels whose webs are mutually parallel and spaced mutually forming a track that extends along a length of the respective beam; and a gantry supported on the track of each beam for travel along the length of the beams, the gantry comprising two interconnected-gantry channels for supporting a trolley of the crane.

6. The composite frame structure of claim 5, wherein the frame further comprises:

four rails; and two beams; and wherein each column comprises four parallel interconnected-column channels.

7. The composite frame structure of claim 5, further comprising:

interconnecting fittings secured to an outside of the interconnected-column channels for connecting the column channels into the hollow rectangular cross-sectional shape.

8. The composite frame structure of claim 5, wherein at least one column further comprises:

a plurality of interconnecting fittings, with each interconnecting fitting secured to one of the corresponding interconnected-column channels; and an angle bracket secured to one of the interconnecting-column fittings and supporting an end of one of the rails on the respective column.

9. A composite structure for framing, comprising:

column and rail channels, each channel including a web, first and second legs, and first and second cylinders, each leg extending at an incline relative to the web at an angle less than 90 degrees to form a concave channel interior, each cylinder is located along a side edge of one of the legs opposite the web, a plane surface of each leg is tangential to the respective cylinder so that the cylinder is on the opposite side of the plane surface and within the concave interior of the respective channel;

columns, each column comprising interconnecting column channels having adjoining paired legs and webs forms a hollow rectangular cross-sectional sham a clamp fitting comprising a compression inter component contoured to fit against one of the cylinders between the opposing channels, and a cap overlapping and secured to the inter component to compress the corresponding cylinder therebetween, wherein the cap engaging a plane surface portion of each of the legs of the opposing channels; and a plate secured by a threaded hole formed into and at an end of at least two of the cylinders.

* * * * *